US005693369A

United States Patent [19]

Russell

[11] Patent Number: 5,693,369

[45] Date of Patent: Dec. 2, 1997

[54] PROCESS FOR FINISHING A BRONZE SCULPTURE

[76] Inventor: Rosemarie M. Russell, 3986 Mt. Olympus Way, Salt Lake City, Utah 84124

[21] Appl. No.: 585,891

[22] Filed: Jan. 16, 1996

[51] Int. Cl.[6] ..... B05D 3/12; B05D 1/32; B08B 5/00

[52] U.S. Cl. ..... 427/270; 427/272; 427/282; 427/327; 134/2

[58] Field of Search ..... 427/270, 272, 427/282, 290, 292, 156, 299, 327; 134/2, 7; 434/82

[56] References Cited

U.S. PATENT DOCUMENTS

| | | | |
|---|---|---|---|
| 3,514,312 | 5/1970 | Gardiner | 427/292 |
| 4,536,454 | 8/1985 | Haasl | 428/516 |
| 4,716,690 | 1/1988 | Szücs | 51/321 |
| 4,727,013 | 2/1988 | Pentak et al. | 430/320 |
| 5,143,949 | 9/1992 | Grogan et al. | 523/334 |
| 5,462,605 | 10/1995 | Szücs | 134/7 |

OTHER PUBLICATIONS

Methods For Modern Sculptors, by Ronald D. Young and Robert A. Fennell; Ch. 8 "Polishing and Patination" pp. 174–208. No Date.

The Colouring, Bronzing And Patination Of Metals, by Richard Hughes and Michael Rowe, "Metal Colouring Techniques" pp. 23–46. No Date.

*Primary Examiner*—Shrive Beck
*Assistant Examiner*—Fred J. Parker
*Attorney, Agent, or Firm*—M. Reid Russell

[57] ABSTRACT

A process for finally finishing a surface of a bronze sculpture that is then waxed with at least a single wax coating. In a practice of the invention, to a bronze surface that has been polished and preliminarily buffed, a low pressure grit material flow is directed against a section of the bronze surface as a final surface texturing step and, where a surface or surfaces adjacent to the section is to be painted, patinaed, or is to receive a like surface finish, a selected plastic material is used to coat the section of the bronze surface, which material is applied as a liquid and dries to a flexible surface that adheres to so as to essentially render the bronze surface imperious to contamination with paint, water, or the like. After application of paint, patina, or the like, the plastic material coating is stripped away by a painter/operator using a tool or tools, such as a pair of tweezers, to remove the coating. Whereafter the sculpture surface is waxed.

4 Claims, 4 Drawing Sheets

PROCESS FOR FINISHING A BRONZE SCULPTURE

BACKGROUND OF THE INVENTION

1. Field of the Invention

The invention relates to processes for finishing bronze sculptures to provide an attractive and protective finish to the bronze surface that is resistive to discoloration with aging.

2. Prior Art

Sculptures as works of art are often first formed in clay, or other material, wherearound a mold is formed to receive hot wax poured therein to form a wax casting. The wax casting is then used in a lost wax casting procedure to form a bronze casting having the shape of the original clay. This procedure has, of course, been long known, and such castings are found even in very early civilizations. In fact, in many respects such earlier bronze castings are not much different from those as are produced today. Nor, in fact, are the finishes and the finishing processes as are currently practiced very different from such earlier procedures. Writings from as early as the fifteenth century that describe processes for casting of bronze sculpture, polishing and buffing thereof, and application of finishes, such as patinas, and final waxing, are similar to processes as are practiced today. Where machines and their use, such as power grinders, sand blasters, and the like, have made the performance of steps in such polishing of a bronze surface to smooth it, and buffing of the smooth surface, much easier, the steps themselves and purposes of each are essentially the same. Also, such processes have further included an application of a coating or coatings of wax to the buffed surface to preserve that finish.

Both ancient and modern bronze polishing and buffing procedures have recognized the advisability of moisture and contaminant removal from the bronze surface before application of a final wax coating thereto to avoid discoloration of the metal surface over time. Accordingly, a work, during polishing and buffing, has been subjected to heating as in an oven, application of a flame thereto, as with a propane torch, or the like, to drive off water. Also, where a patina has been applied, the patina surface has often received an application of a flame directed thereagainst as a final step before waxing. Such heating, while effective to remove water and even burn off oils as have been present on the bronze surface, have often not fully removed such water and surface contaminants that, over time, have reacted with moisture and pollutants in the air to discolor the metal surface. The present invention, prior to application of a wax coating to seal and preserve the bronze finish, provides for more completely removing water as has collected in the pores of the metal surface and contaminants, such as skin oils on the metal surface. To effect this cleaning the invention performs the step of directing a broad stream of a dry grit material, such as an aluminum oxide fine grain sand, under low pressure, against the metal surface, thereby thoroughly dewatering and cleaning that surface, and providing also a final surface texturing. Further, as distinguished from earlier procedures, the invention provides for applying, as with a brush, a flexible plastic material, or the like, onto the sand blasted surface of the bronze to protect it while adjacent surfaces are being finished, as by painting, patinaing, or the like. The preferred applied coating is a flexible plastic material that is applied in a liquid state and, when dry, provides a flexible surface that will not be affected by a spraying of the adjacent areas with paint, water, or other liquid, and is resistive to an application of heat, even a flame as used in an application of a patina. The selected plastic coating can be removed as by pulling it in long and short strips off from the sand blasted surface, without contaminating it. Thereafter, as a final step, the work is waxed, sealing and protecting the surface that, when the work is maintained in a protected environment, will exhibit a consistent shine or luster over an extended period of time in years with little or no care required except for an occasional application of an appropriate wax to the sculpture surface.

SUMMARY OF THE INVENTION

It is a principal object of the present invention in a process for finishing a bronze sculpture to provide as final steps in the buffing of the bronze sculpture surface for directing a stream of a fine grit material over a section of the surface as a final buffing step to provide surface texturing, and to dewater and remove oils therefrom, prior to application of a wax coating to the surface to seal it.

Another object of the present invention is to provide for directing a broad stream of fine grit material, such as a fine grain aluminum oxide, at low pressure, against the bronze surface over a sufficient period of time to provide surface texturing, dewatering, and for removal of oils therefrom.

Another object of the present invention is to provide for coating areas of the sculpture surface as have been sand blasted to protect them from contamination from finishing, as by painting surfaces adjacent thereto, with a coating of a plastic material that is applied in a liquid state and will dry to a flexible impervious coating to protect the sand blasted surface from contamination, that is easily stripped away using a tool or tools to receive a wax coating.

Still another object of the present invention is to provide for a selection of a plastic material that is applied in a liquid state to any appropriate thickness that, when dry, forms a flexible coating that is impervious to liquids and seals the surface it is applied to against contamination as adjacent surfaces are finished, and that can easily be removed as by peeling it in strips off from the surface by an operator using a tool or tools.

Still another object of the present invention is to provide the process steps of the invention that are final buffing steps conducted prior to application of a wax coating to the bronze surface to preserve and protect the surface from reactions as would discolor it over time.

The invention is in steps of a process for polishing and buffing a surface of a bronze casting in finishing that casting to a finished bronze sculpture whereover wax or other sealant is applied. In the finishing process, polishing provides for a removal of unwanted materials from the surface of a bronze casting, with buffing to finish that surface to a surface to receive an application of a finish wax or other sealant applied thereover to seal and protect the surface. The invention adds, to the buffing process, the step of applying a flow of a grit material at low pressure and in a broad stream to the bronze surface to provide a final surface texturing and to dewater and clean off contaminants, such as skin oil, therefrom. The preferred grit material used in this step is a dry fine grain aluminum oxide that is applied to the surface as needed, until a desired surface texturing is obtained.

Where a sand blasted section or sections of the bronze surface only are to be waxed or have other sealant applied thereto as a finished surface, and where, prior to that waxing, adjacent areas thereto are to be painted, patinaed or have other surfaces applied thereto, as a further step of the invention, the sand blasted surface or surfaces are protected by an application of a surface coating that is flexible and provides an impervious seal to the surface over which it is applied. The preferred coating material seals but is easily removed by an operator, using a tool or tools, to pull the dried material off of the sand blasted area. The surface coating thereby protects the bronze surface from contamination and the preferred selected coating material will not itself contaminate the bronze surface that remains ready to receive a coating or coatings of wax or other sealing agent applied thereto. One such coating material that is suitable for providing such a protective surface coating is a plastic material that is applied in a liquid state and dries to a flexible impervious coating is known as PLASTI DIP®, manufactured by PDI Inc. of Circle Pines, Minn. Though, it should be understood, other like coating materials having similar characteristics and properties could be so used within the scope of this disclosure.

After cleaning the coating material off from the sand blasted portions of the sculpture, the painted and sand blasted surfaces are preferably waxed by an application of one or more coats of a selected wax that is suitable for use on bronze sculptures and that wax can be polished as desired. The wax or other appropriate sealant coating, when the work is maintained out of the elements, provides for protecting the bronze surface from the effects of moisture and pollutants in the air. Bronze surfaces, prepared as described above, when so protected by a wax or other sealant coating, will maintain their appearance without streaking or staining over a long period of time in years.

DESCRIPTION OF THE DRAWINGS

In that drawings that represent the best mode presently contemplated for carrying out the invention.

DETAILED DESCRIPTION OF THE INVENTION

Figure 1:
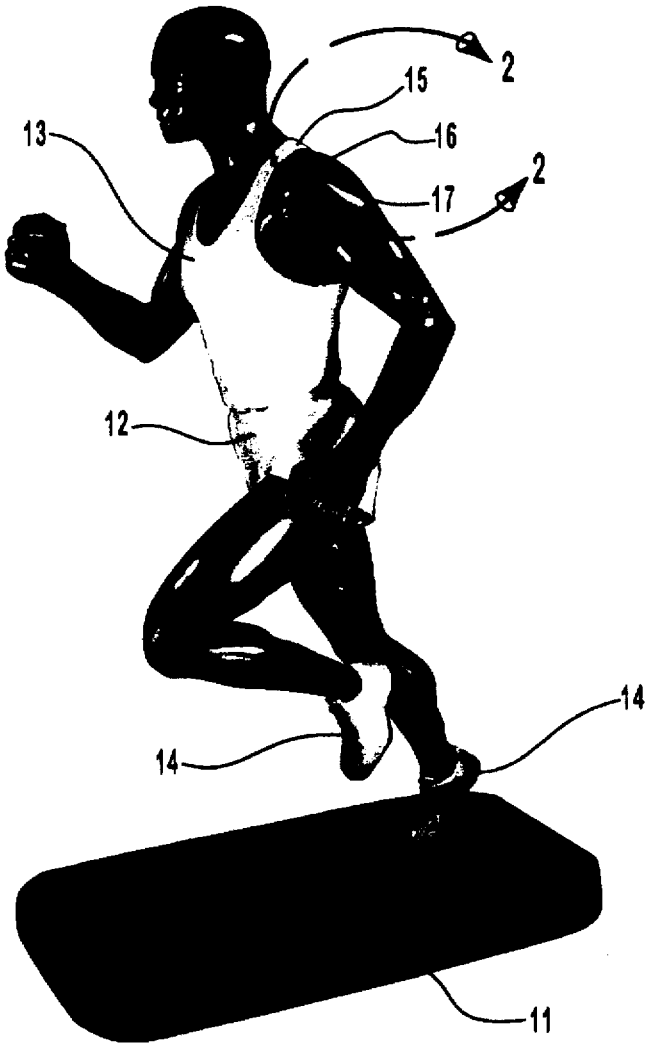
FIG. 1 is a photograph showing an elevation perspective view taken from the front and left side of a sculpture of a male runner that was finished utilizing the process of the invention.

FIG. 1 shows a sculpture of a male runner 10 mounted on a base 11, with the runner shown as having painted running shorts 12 and top 13, and showing him with painted shoes 14. The runners arms, legs, neck and head area are shown as being polished. The invention, it should be understood, is in steps that are performed in buffing the bronze surfaces of the arms, legs, neck and head areas and for protecting these surfaces during application of a surface coating, such as paint, patina, or the like, to areas of the sculpture surface, shown in FIG. 1 as the painted shorts 12, top 13 and shoes 14.

Figure 2:
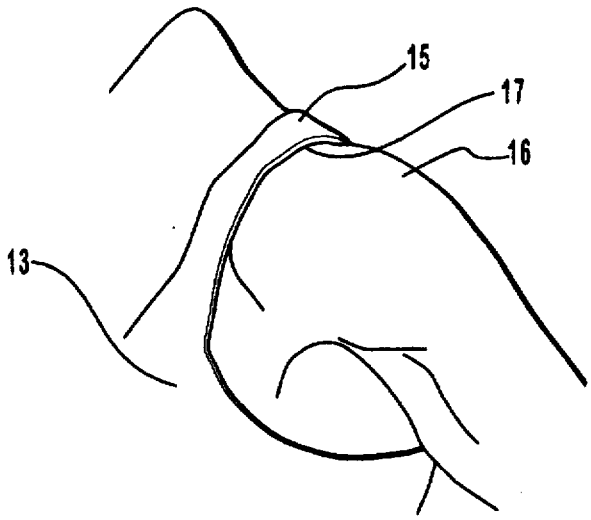
FIG. 2 shows an enlarged view of a section of the surface of the sculpture taken within the line 2—2 of FIG. 1, showing lines of separation between the surface of the runner's arm, shoulder and top.

FIG. 2 is enlarged section of the left shoulder area of the runner 10, showing a portion of a left strap 15 of the top 13 and the runner's polished shoulder 16, and showing a junction therebetween as a line 17 demarkation or of separation. The section of FIG. 2, that is shown in FIGS. 2A through 2E, is provided for describing the performance of the steps of the invention. FIG. 3 shows the runner left shoulder area receiving an application of a layer of wax applied thereto by contact and rubbing with a cloth 28 that, it should be understood, is held in a artist/operator's hand 18.

FIG. 2 shows a section of the bronze surface after it has been polished and initially buffed, and prior to an application of a final surface finish that, as shown in FIG. 1, is a surface painted onto the top 13 strap 15. It should be understood that, prior to the performance of the finishing steps of the invention, the bronze, after casting, will have been subjected to a polishing where surface blemishes are removed and the surface is initially smoothed. Such steps involve grinding, as with a sanding disks ranging from course to fine. Such sanding disks are turned in an angled grinder, drill, or the like, and the piece is subjected to wire brushing and polishing utilizing polishing disks that range from course to fine, and sand basting with an appropriate grit of material that is directed under high pressure against the bronze surface. These steps are well known and have been long used. The buffed bronze surface is then ready for the performance of the step of the invention of applying to the surface a low pressure sand blasting flow that has a wide pattern directed particularly to the areas of the bronze that are to be polished, set out below.

Figure 2A:
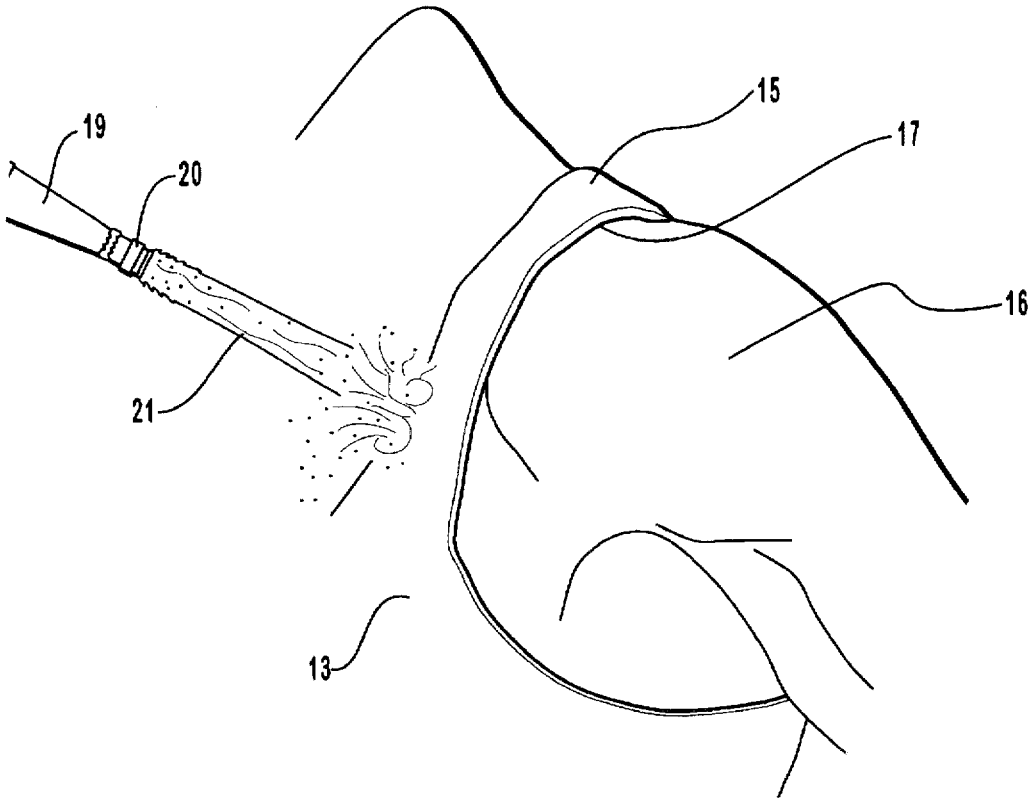
FIG. 2A shows an enlarged view of the section of FIG. 2 receiving a flow of a fine grit material under pressure directed thereagainst.
Figure 3:
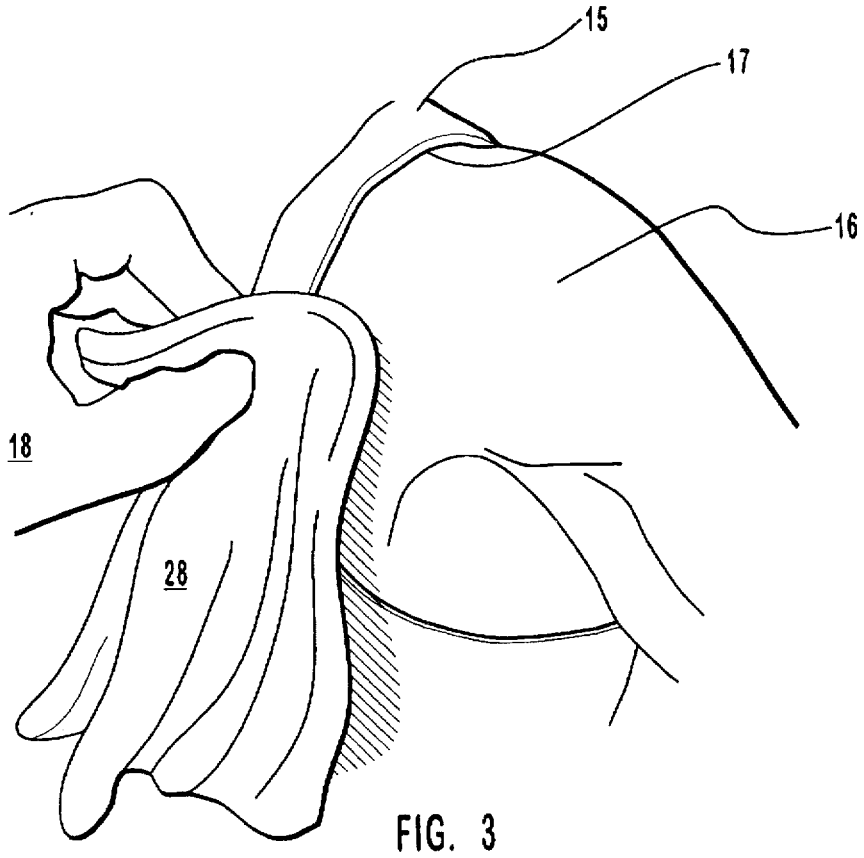
FIG. 3 shows the section of FIG. 2, processed as shown in FIGS. 2A through 2E, receiving a coating of wax applied thereover utilizing a cloth that is maintained in the operator's hand.

FIG. 2A shows the section of FIG. 2 receiving a wide spray pattern 21 of grit material passed from a nozzle end 20 of a wand 19 that, it should be understood, is connected to an air line and to a grit material feed line, not shown, with the nozzle end 20 pointing at and spaced an appropriate distance, as set out below, to direct the grit material against the bronze surface. The pattern is preferably under a pressure of from ninety (90) to one hundred ten (110) psi. A preferred grit material is an aluminum oxide that has a grain size of, approximately, from twenty five (25) to fifty (50) microns selected to provide a final surface finishing. In this final finishing, the bronze surface is both dried of surface water and any oil, including oils as are present on a operator's skin, are removed. To perform this sand blasting step nozzle 20 is held a distance of approximately fifty (50) to one hundred (100) millimeters away from the bronze surface, and has an opening to pass, when maintained at these preferred distances from the bronze surface, a flow therethrough that will have a diameter of approximately seventy five (75) to one hundred (100) millimeters where it strikes the bronze surface. In practice, as determined by the artist/operator, this step is practiced for a period of time as the artist/operator determines to complete the final surface finishing.

Figure 2B:
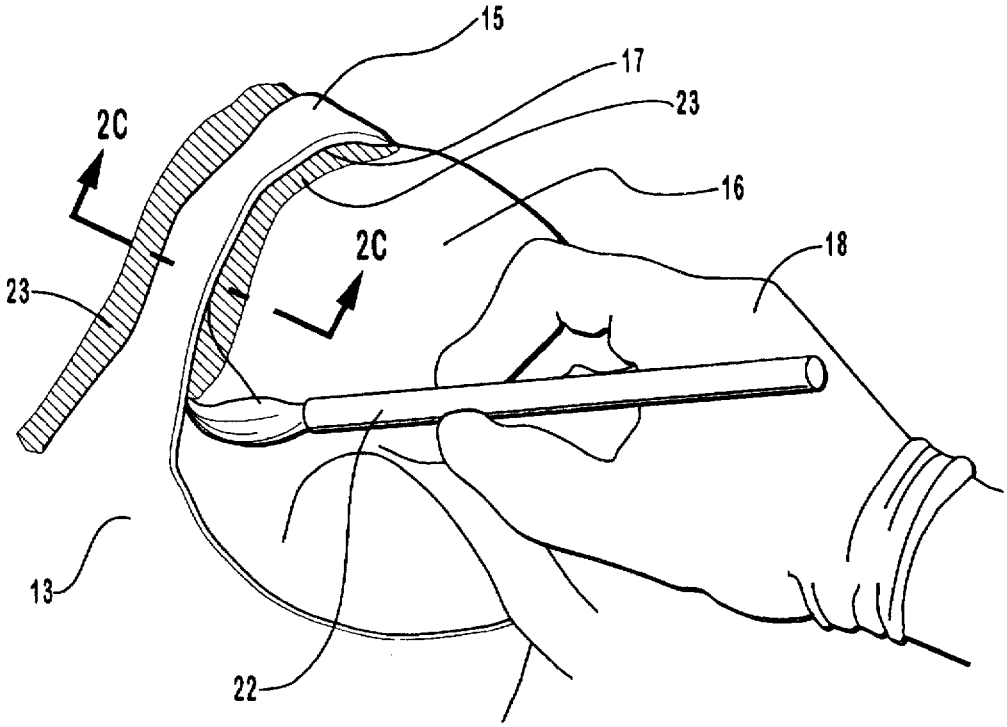
FIG. 2B shows the runners arm portion of FIG. 2A receiving a coating of a liquid material applied with a brush up to the lines of separation with the runner's top.
Figure 2C:
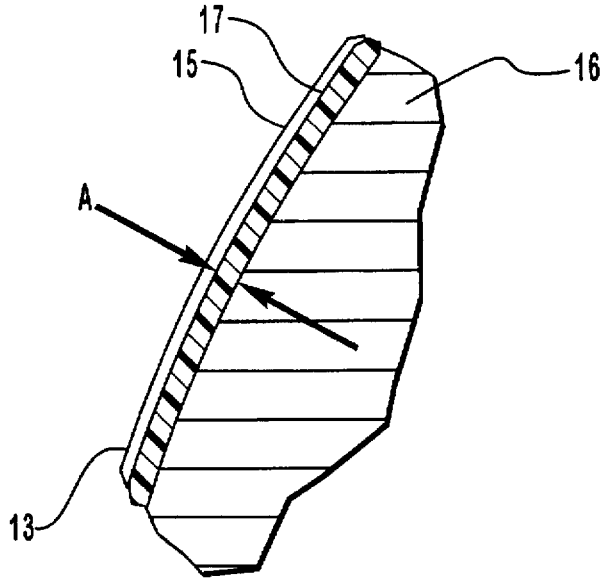
FIG. 2C is an enlarged cross section taken within the line 2C—2C of FIG. 2B illustrating with arrows A the thickness, after drying, of the coating material identified as a plastic.
Figure 2D:
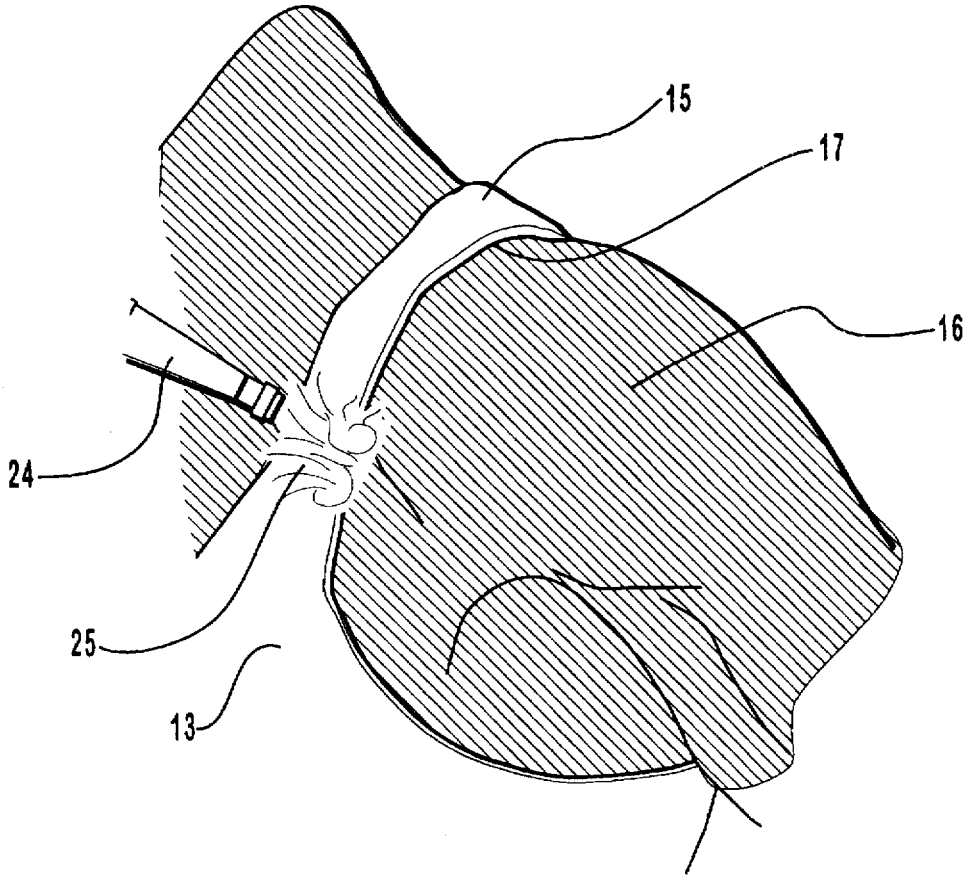
FIG. 2D shows the runner's top of FIG. 2A being spray painted, showing some of the sprayed paint overspraying onto the plastic coated arm portion.

FIG. 2B shows the runners arm 16, that has been finally finished as described above with respect to FIG. 2A, receiving a coating 23 applied thereto by a brush 22 held in the artist/operator's hand 18. The coating 23 is being applied to the arm 16 surface, up to the line 17 between the top strap 15 and arm 16, and over the shoulder area beyond the top strap to cover the areas that do not receive paint, as shown in FIG. 2D. The coating 23 is preferably one that can be applied in a liquid form to dry into a resilient coating that seals the area whereover it is applied against contamination, particularly contamination by water. One such coating material as has been used successfully for this application and is preferred, is a plastic material known as Plasti Dip®, manufactured by PDI, Inc. of Circle Pines, Minn. This material can be applied by brushing it on and will dry to the desired flexible coating in approximately four (4) hours. Coating 23 is shown as being a plastic material in the cross section of FIG. 2C. As shown by the spacing distance between pointed ends of arrows A, the coating has a thickness that, in practice is preferably from 0.2 to 0.5 millimeters. The preferred coating material will not introduce contaminants such as water, oil, or other contaminants to the bronze surface either when it is applies in a liquid state or after drying. Once dried, the covered areas can be handled by the artist/operator, during spray painting, as set out below. Removal of the coating 23 is set out and described hereinbelow with respect to a discussion of FIG. 2E.

FIG. 2D shows a spray gun nozzle end 24 with a spray 25 of paint emitted therefrom that is directed onto the top strap 15, with an overspray shown striking over the line 17 and beyond onto the coating 23 covering arm 16. The coating 23 protects the arm 16 surface and prohibits a penetration of the paint spray under the coating along the line 17. Also, the coating 23 closely adheres to the arm surface as an impervious barrier protect against a water spray or even an immersion in water for a short period of time, as could be involved in a practice of a patina procedure.

Figure 2E:
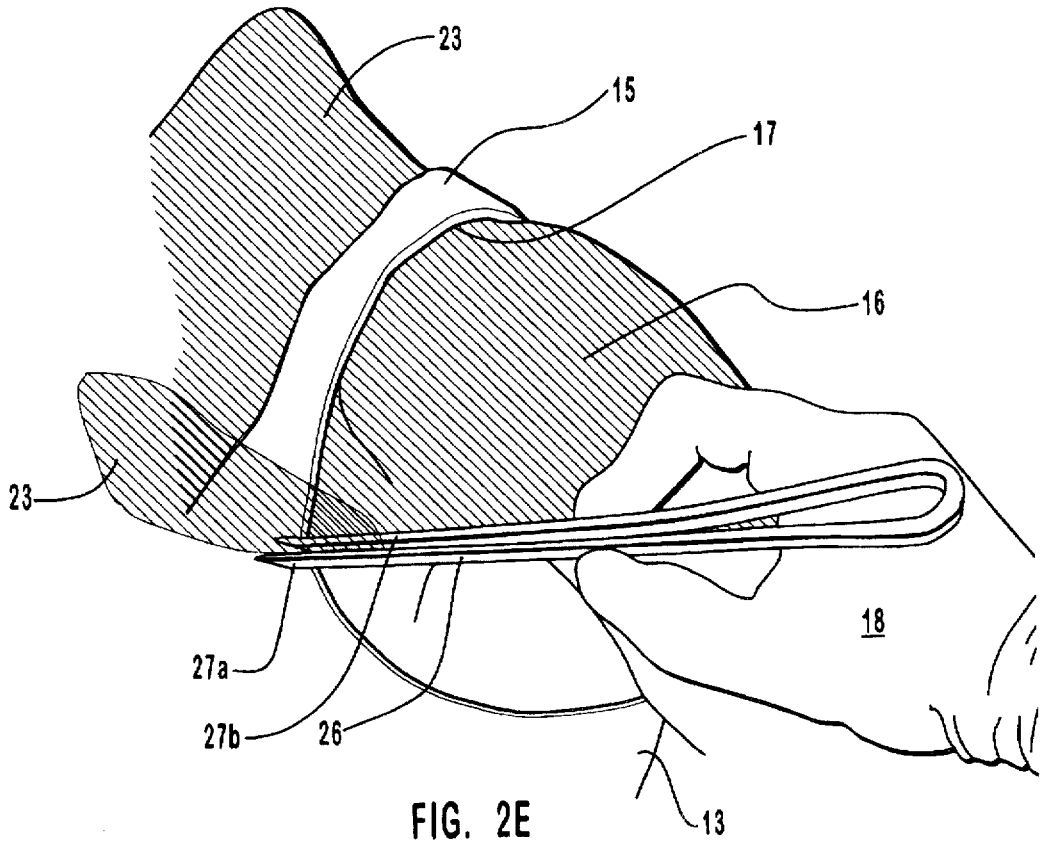
FIG. 2E shows an operator's hand holding tweezers and using them to remove strips of the plastic coating of FIG. D.

FIG. 2E shows the artist/operator's hand 18 holding a pair of tweezers 26 that are shown gripping, between tweezer ends **27*a* and 27*b*, a section of the coating 23 to pull it off from arm 16. Additionally, another tool, such as a knife, or the like, can be used to pry up a coating section for gripping between the tweezer ends. It being understood that the coating 23 is removed using tools without the artist/operator contacting the surface with their hands. With the removal of all of the coating 23 and the complete drying of the painted surfaces, on the bottom, top and shoes of FIG. 1, a wax finish is applied to the bronze 10 surface utilizing, as shown in FIG. 3, a wax impregnated cloth 28, or the like, held in the artist/operator's hand 18**.

In practice, a bronze sculpture 10 whose surface has been subjected to a final surface finishing, as set out above, and with that surface protected with a flexible plastic coating, receives an application of a surface coating, such as paint, to adjacent surfaces. After waxing, as long as the sculpture is maintained in a protected environment, the bronze surface, with only an occasional application of additional wax, will not stain or streak over an extensive period of time in years.

While a preferred form of my invention in a process for finishing bronze sculptures has been shown and described herein it should be understood that the disclosure is made for example only and that variations, changes and modifications can be made to the described procedures within the scope of this disclosure without departing from the subject matter coming within the scope of the following claims, and a reasonable equivalency thereof, which claims I regard as my invention.

I claim:

1. A process for finishing bronze sculptures where, to a bronze casting surface that has been polished to remove unwanted material, and after said bronze casting surface has been initially buffed, said process consists of;

(a) directing, to a portion of said bronze casting surface that is to be polished only, a flow of an abrasive material contained in a dry flow of air under a pressure of from 90 to 110 psi through a nozzle end that is maintained at a distance of from 50 to 100 millimeters above a portion of said bronze casting surface and wherein said nozzle directs a spray pattern onto said portion of said bronze casting surface that is of a diameter of from 75 to 100 millimeters, and where said abrasive material has a grain size of 25 to 50 microns;

(b) applying a liquid flexible plastic coating composition to the portion of said bronze casting surface that has been polished, and which is adjacent to an uncoated bronze casting surface which is to be painted or patinaed after said liquid flexible plastic coating composition has dried to form a flexible plastic coating;

(c) painting or patinaeing the uncoated bronze casting surface;

(d) after the paint or patinae has dried, removing said flexible plastic coating by an operator using a tool or tools to pull off said flexible plastic coating; and (e) applying at least one coating of a sealant material over the entire bronze casting surface.

2. A process as recited in claim 1, wherein the flexible plastic coating composition is applied in a liquid state and dries to a water impervious flexible coating; and the sealant material is a wax.

3. A process as recited in claim 2, wherein the liquid flexible plastic coating composition is coated over the bronze polished surface to a thickness of from 0.2 to 0.5 millimeters and is allowed to dry in air to a flexible water impervious flexible plastic coating.

4. A process as recited in claim 1, wherein a pair of tweezers are used to peel the flexible plastic coating, in stripes, off of the polished bronze surface.

* * * * *